United States Patent [19]

Ledgerwood

[11] Patent Number: 4,513,899

[45] Date of Patent: Apr. 30, 1985

[54] STOCK FEEDER WITH ADJUSTABLE WIDTH FEED PATH

[75] Inventor: Harry J. Ledgerwood, Conway, Mo.

[73] Assignee: Plessey Incorporated, Melville, N.Y.

[21] Appl. No.: 406,766

[22] Filed: Aug. 10, 1982

[51] Int. Cl.[3] ..... B65H 17/36; B65H 23/02

[52] U.S. Cl. ..... 226/141; 226/150; 226/159; 226/162; 226/199

[58] Field of Search ..... 226/146, 147, 148, 149, 226/150, 151, 141, 159, 136, 139, 137, 162, 199, 167, 166, 165, 164, 163, 108; 83/277; 254/211

[56] References Cited

U.S. PATENT DOCUMENTS

| | | | |
|---|---|---|---|
| 2,622,874 | 12/1952 | Haller | 226/150 |
| 2,670,953 | 3/1954 | Marsilius | 226/141 |
| 2,721,649 | 10/1955 | Powers | 226/141 |
| 2,978,160 | 4/1961 | Bunnell | 226/151 |
| 3,140,032 | 7/1964 | Heath et al. | 226/141 |
| 3,148,817 | 9/1964 | Lord | 226/137 |
| 3,329,327 | 7/1967 | Scribner | 226/150 |
| 3,438,557 | 4/1969 | Lehmann | 226/165 X |
| 3,613,980 | 8/1969 | Kulig et al. | 226/162 |
| 3,643,845 | 2/1972 | Phillips | 226/150 X |
| 3,753,522 | 8/1973 | Voges | 226/150 X |
| 3,937,379 | 2/1976 | Narwid et al. | 226/150 |
| 4,059,212 | 11/1977 | Ledgerwood | 226/141 |
| 4,312,469 | 1/1982 | Nilsson | 226/150 |

*Primary Examiner*—Harvey C. Hornsby
*Assistant Examiner*—Scott J. Haugland
*Attorney, Agent, or Firm*—Fleit, Jacobson, Cohn & Price

[57] ABSTRACT

A stock feeder for repetitively feeding uniform segments of a continuous web of stock material from a roll to a production machine. The feeder comprises a frame, a pair of hold clamps located on the front portion of the frame, and a movable feed block which carries a pair of feed clamps that grips and pulls the stock material to a position which is held by the hold clamps. To obviate the necessity to reposition the clamps when changing the width of stock material, the frame includes first and second pairs of laterally adjustable stock roller guides located, respectively, on its front and rear portions. Also, to enable the feeder to operate faster without destruction or deterioration, and yet still attain good positioning accuracy of the stock material, the movable carriage includes a double acting hydraulic shock absorber rod which engages, respectively, at its forward and rearward stroke limits, an adjustable stud in the front portion of the frame and a fine adjustment stop bar disposed at the rearward portion of the frame. A pad of elastomer material also is used to cushion and reduce impact noise of the shock absorber.

5 Claims, 4 Drawing Figures

STOCK FEEDER WITH ADJUSTABLE WIDTH FEED PATH

CROSS-REFERENCE TO RELATED PATENTS

This invention is related to U.S. Pat. No. 4,059,212 issued Nov. 22, 1977 entitled "Stock Feeder For Punched Stock," assigned to the assignee hereof, and being incorporated herein by reference.

BACKGROUND OF THE INVENTION

Field of the Invention

This invention relates to a material handling device, more commonly known as a stock feeder or jig, for repetitively feeding or advancing uniform segments of stock material into a production machine which performs work on the segments of the stock material. Specifically, the invention relates to an improvement to such a device which renders it more readily adaptable to handle stock material of different widths.

Automatic stock feeders have been used with production machinery to attain relatively high production rates of articles manufactured from stock material which is wound on a spool or a roll. To handle the material on the spool or roll, as the case may be, some conventional feeders employ at least one set of clamps to grip and pull periodically during feeding and another set of clamps to hold the stock material in place while the machine works on a segment of the material to form an article of manufacture. For narrow stock material, a single gripper will suffice for handling each of the pulling and holding operations, but for wide stock material, say twelve inches or more, a pair of grippers is used at each end of the feeder. Some older types of feeders employ a pair of opposed rollers, instead of grippers (i.e., roll feeder), to perform these functions, but due to occasional slippage between the stock material and the rollers, these types of feeders have not proved as efficient and reliable as grip feeders.

Production operations performed by the machine may involve forming, cutting, milling, stamping, machining, etc., and the stock material from which the article is manufactured may comprise wire, metal tubing, sheet metal, bar steel, etc. or even non-metallic stock material, such as a plastic or fiber material. The feeder itself may be constructed to handle one particular size of stock material, or it may be adjustable, over some dimension thereof, to handle, for example, material of different widths. Obviously, if a production machine is to have versatility, the feeder should also be versatile in handling material of different widths and thicknesses.

If, during a production run for manufacturing an article, it becomes necessary to change the width of the feed path through which the material passes, normal practice is for a machine operator to shut down the machine, reposition a feed clamp and hold clamp located on one side of the feed path, and/or adjusts the beginning and end positions of the feed stroke on clamp carriages on both sides of the feeder, if required. These operations require a certain amount of time and skill on the part of the machine operator, and if it not performed properly and quickly, valuable production time can be lost. Therefore, it is advantageous to construct such feeders in a manner which enables them to be quickly adjusted with minimal skill.

U.S. Pat. No. 3,613,980 describes at least one type of stock feeder device which uses a pair of feed clamps for gripping a sheet of stock material and advancing a segment thereof and a pair of hold clamps for holding the segment at a fixed position while a machine works on the stock material. In this device, the hold and feed clamps also provide guiding edges against which the stock material abuts. So, each time it becomes necessary to use stock material of a different width, the entire clamp assembly on at least one side of the feed path must be repositioned. To accomplish repositioning, the feeder employs a clamp carriage that simultaneously displaces both the feed clamp and the hold clamp on one side of the feed path. The carriage, in turn, includes a guide rail and a manually driven actuator for moving the clamps to their new position. If a longitudinal change in stroke path is required, it is necessary to adjust the position of the clamps on each side of the feeder. The expense and complexity of such an arrangement can readily be appreciated.

U.S. Pat. No. 4,059,212 assigned to the assignee hereof describes a stock feeding apparatus, but it possesses only a single feed clamp actuator and a hold clamp actuator. This feeder is suitable for repetitively handling segments of relatively narrow stock material and is not adjustable, per se, to handle material of different widths.

In view of the foregoing, it is an objective of this invention to provide a material handling device of greater versatility for handing both narrow and wide stock material.

Another objective of this invention is to provide a material handling device possessing width-adjusting stock roller guides in front and rear portions thereof, which device is more readily adjustable to handle material of different widths.

Another objective of this invention is to provide a material handling devioe for automatically and repetitively feeding segments of stock material, which device can conveniently and quickly be adjusted with minimum time and skill thereby to reduce down time during stock changeover periods.

Another objective of the invention is to provide a material handling device wherein the respective pairs of feed clamps and hold clamps are mounted on respective front and rear blocks of the feeder in a fashion so that only the clamp heads, rather than the clamp carriage, need be repositioned for substantial changes in feed-path width; and only one block, rather than two clamp heads, need be adjusted for a change in stock length.

A further objective of the invention is to provide a material handling device for automatically feeding segments of stock material, which device is economical, reliable, and simple in construction.

SUMMARY OF THE INVENTION

The foregoing objectives and advantages of this invention are attained by providing a stock feeding device comprising a frame having a front and rear portion, at least one guide rod extending between the front and rear portions of the frame, and a movable feed block that is cyclically driven about the guide rods by an actuator. A pair of pneumatically operated feed clamps are mounted on the movable feed block for gripping and pulling the stock material, and a corresponding pair of pneumatically operated hold clamps are mounted on the front portion of the frame for holding in place the stock material while a machine performs work on it. Additionally, two pairs of stock roller guides are mounted on the frame, one pair being mounted on the rear portion and a seoond pair being mounted on the front portion. These stock roller guides are adjustable, laterally across the feed path, to abut the edge of the stock material as it passes through the feeder. Since the stock roller guides provide and establish the width of the feed path for the stock material, it does not always become necessary to change the lateral positions of the feed and hold clamps to adapt the feeder to stock material of a different width. Thus, the clamps may remain in an approximated lateral position so long as the required change in stock material width is not substantial. This arrangement eliminates the necessity to provide a clamp carriage as required by prior art devices.

As with many such stock feeding devices, the feed block is driven by a pneumatic actuator comprising a piston and cylinder arrangement, and limit switches are disposed at the beginning and end portions of the stroke of the feed block to actuate air valves for operating the feed clamps and hold clamps in a fashion to grip, release, and hold the material during the cyclic operation of the feeder.

Other advantages, features and aspects of the invention will become apparent upon review of the succeeding disclosure taken in connection with the accompanying drawings. The invention, however, is pointed out with particularity in the appended claims.

DESCRIPTION OF THE ILLUSTRATIVE EMBODIMENT

Figure 1:
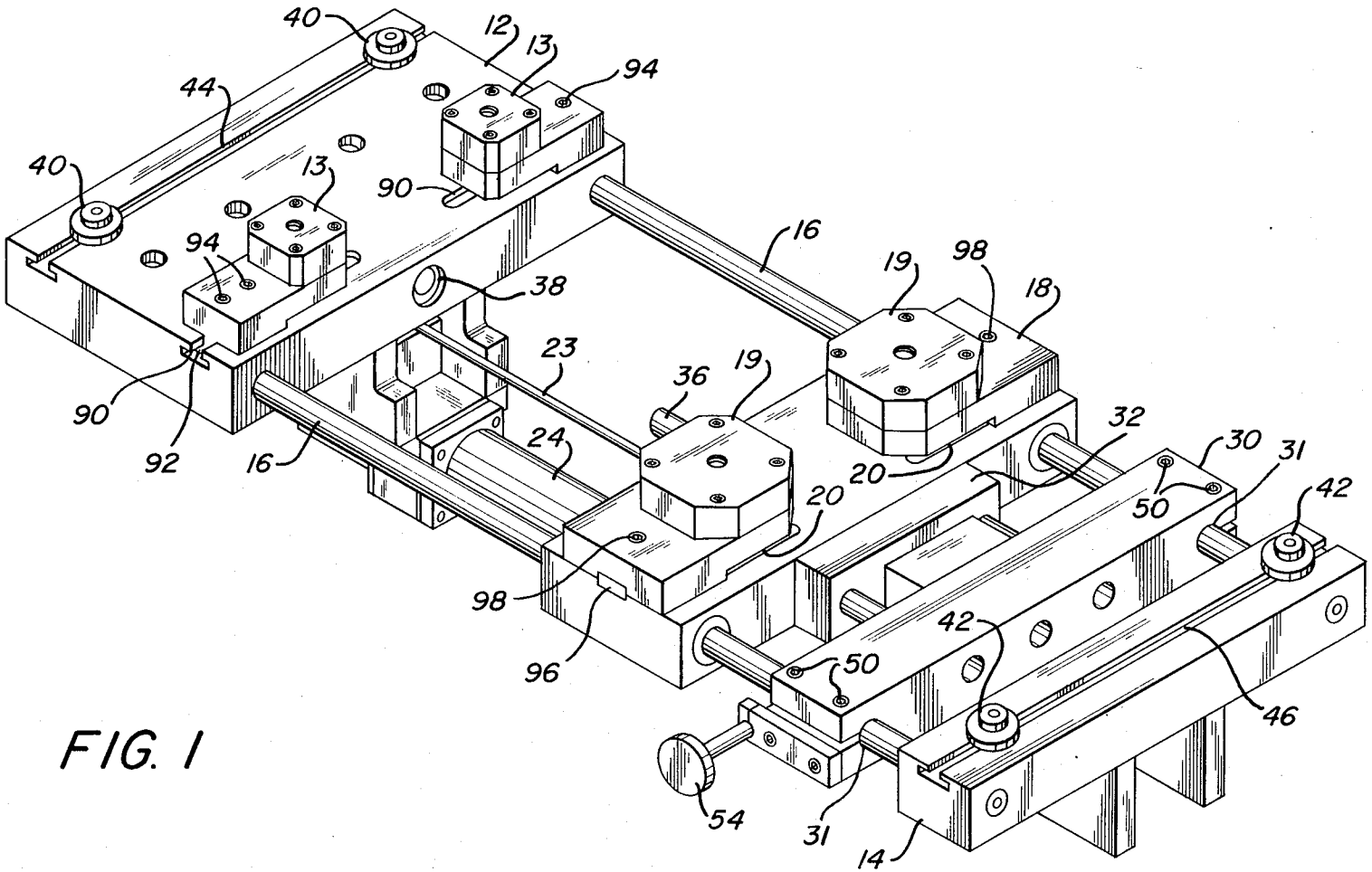
FIGS. 1 and 2 depict perspective, front and side views of a stock feeder embodying the principles of our invention.
Figure 2:
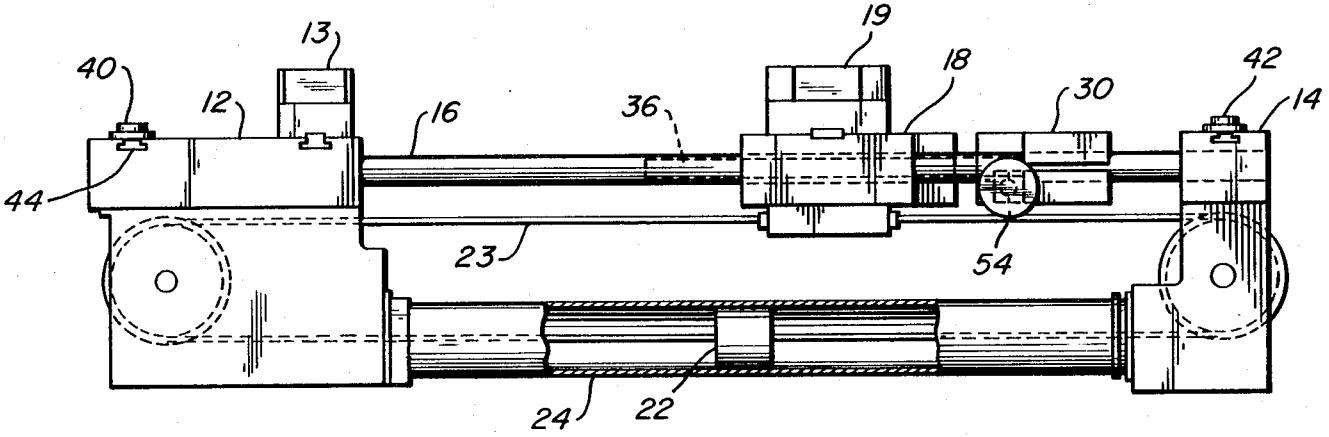

An apparatus constructed in accordance with this invention is shown in FIGS. 1 and 2 in which a frame is constituted by a front portion 12, a rear portion 14, and a pair of guide rods 16. A pair of laterally adjustable stationary hold clamps 13 are disposed on the front portion 12 of the frame. The hold clamps 13 hold in place the stock material (not shown) as it passes through a feed path over the frame. The guide rods 16 provide structural integrity of the frame by interconnecting the front and rear portions 12 and 14 as well as providing the longitudinal guide path along which the feed block 18 reciprocates.

The feed block 18 carries a pair of laterally adjustable gripper assemblies 19, which in their slots 20 include a pneumatically operated piston to clamp a sheet of stock material (not shown) thereby to pull it, upon movement of the feed block 18, toward the front portion 12 of the frame. Movement of the feed block 18 is accomplished by a pneumatic actuator assembly comprising a piston cylinder arrangement 24 and 22. To move the block 18, a cable 23 couples the piston 22 al a connecting junction 26, and it also couples the feed block 18 at a connecting junction 28. Thus, when the piston 22 is displaced by air pressure from a compressed air source applied the cylinder 24, a force acts upon the feed block 18 through the cable 23 and thus moves the feed block 18 longitudinally along the guide rods 16. As the feed block 18 is moved in a reciprocating manner, the forward and rearward stroke positions of the feed block 18 are controlled in a conventional manner by limit switches which open and close pneumatic valves in a pneumatic circuit coupling the chambers of the cylinder 24. The actual construction and operation of the pneumatic circuit and valves are more particularly described in commonly owned U.S. Pat. No. 4,059,212, incorporated herein.

One of the limit switches is placed on the front portion 12 of the frame and another limit switch is placed on a rearward stop block 30. The stop block 30 also is slidably mounted on the guide rods 16 and establish the rearward stroke position of the feed block 18. To set the rearward stroke position of the feed block 18, bolts 31 are loosened and the stop block 30 is moved to an approximate location about the guide rod 16. Then the bolts 31 are tightened. Coupled to the stop block 30, between it and the feed block 18, is a fine adjustment bar 32 which acts as a fine adjustment for positioning the rearward stroke position of the feed block 18 with greater accuracy within, say two to three inches. The details of the fine adjustment bar will be subsequently described in greater detail.

The stock feeder also includes a hydraulic crash stop assembly located on the feed block 18 for cushioning somewhat the impact of the feed block 18 during reversal of direction at its forward and rearward stroke positions. The crash stop assembly, also being more fully subsequently described, comprises a hydraulic rod 36 located in the feed block 18 and an adjustable crash stop pad 38 mounted in the front portion 12 of the frame. In operation during its forward stroke, the hydraulic bar 36 engages the pad 38, so that as the feed block 18 approaches its forward stroke limit, its speed is reduced in anticipation of releasing the grip of feed clamps 19 on the stock material and of engaging the grip of hold clamps 13 on the stock material. On the reverse movement of the feed block 18, the other end of hydraulic rod 36 engages the fine adjustment bar 32 thereby to slow down rearward motion in anticipation of releasing the grip of hold clamps 13 on the stock material and of engaging the grip of feed clamps 19 on the stock material, and thus readies itself to repeat the feed cycle.

As an additional improvement, to reduce noise resulting from the impact between the hydraulic rod 36 and the pad 38, we have provided a polyurethane cushion on the contact surface of the front portion of the frame. Most any type of resilient material may constitute the cushion so long as it meets durability standards. The polyurethane cushion thus renders the device more quiet in its operation in compliance with noise standards for workers established by governmental agencies, such as OSHA.

Still referring to FIGS. 1 and 2, we provide two pairs of stock roller guides 40 and 42, respectively, on the front and rear portions 12 and 14 of the frame. These stock roller guides establish the width of the path of the stock material, since they abut the edges of the stock material. The roller guides 40 are slidably seated in a guide track 44 disposed on the front portion 12 of the frame, and the roller guides 42 are slidably seated in a guide track 46 disposed on the rear portion 14 of the frame. When it becomes necessary to adjust the width of the feed path, both pairs 40 and 42 of the roller guides are adjusted by loosening a bolt which secures them in a fixed position in their respective guide tracks 44 and 46. The roller guides then are manually moved against thereby to abut the edge of stock material that is placed therebetween during set up operation of the machine.

Once the roller guides are in position, the bolts which secures them in the guide track are tightened to secure the roller guides in a fixed position.

In FIG. 1, laterally adjustable hold clamps 13 are fixedly adjustable by release of bolts 94 and the sliding of the hold clamps 13 towards or away from each other, independent of one another. Keyways 90, defined in the front portion 12 of the frame, interact with correspondingly shaped projections 92 of the holding clamps. The advancing stock material need not be centered between the two holding clamps. If the stock abuts against the edge of the left holding clamp, the right holding clamp is adjustable by release of the bolt 94 and the sliding of the holding clamp 13 on the right side towards the holding clamp located on the left side. The laterally adjustable gripper assemblies 19 located on the unitary feed block 18 have a similar adjustment by bolts 98 for sliding the gripper assemblies in keyways 96. By release of bolts 98, the gripper assemblies are adjustable towards or away from each other, independent of one another. The bolts 98 are then readjusted to fix gripper assemblies to the unitary feed block 18.

Now, as can be appreciated, instead of moving the entire clamp assembly to adapt it to stock material of a different width, in our embodiment, advantageously, it is only necessary that the stock roller guides 40 and 42 be manually positioned to adjust the width of the stock feed path. As a result, it is not necessary to move the position of the feed clamps 19 on the feed block 18, or the hold clamps 13 disposed on the front portion 12, unless there are significant changes to be made in the width of the stock material feed path. Accordingly, adjusting the machine to handle stock material of a different width is a rather simple and uncomplicated procedure which quickly can be done thereby to minimize production machine down time.

Figure 3:
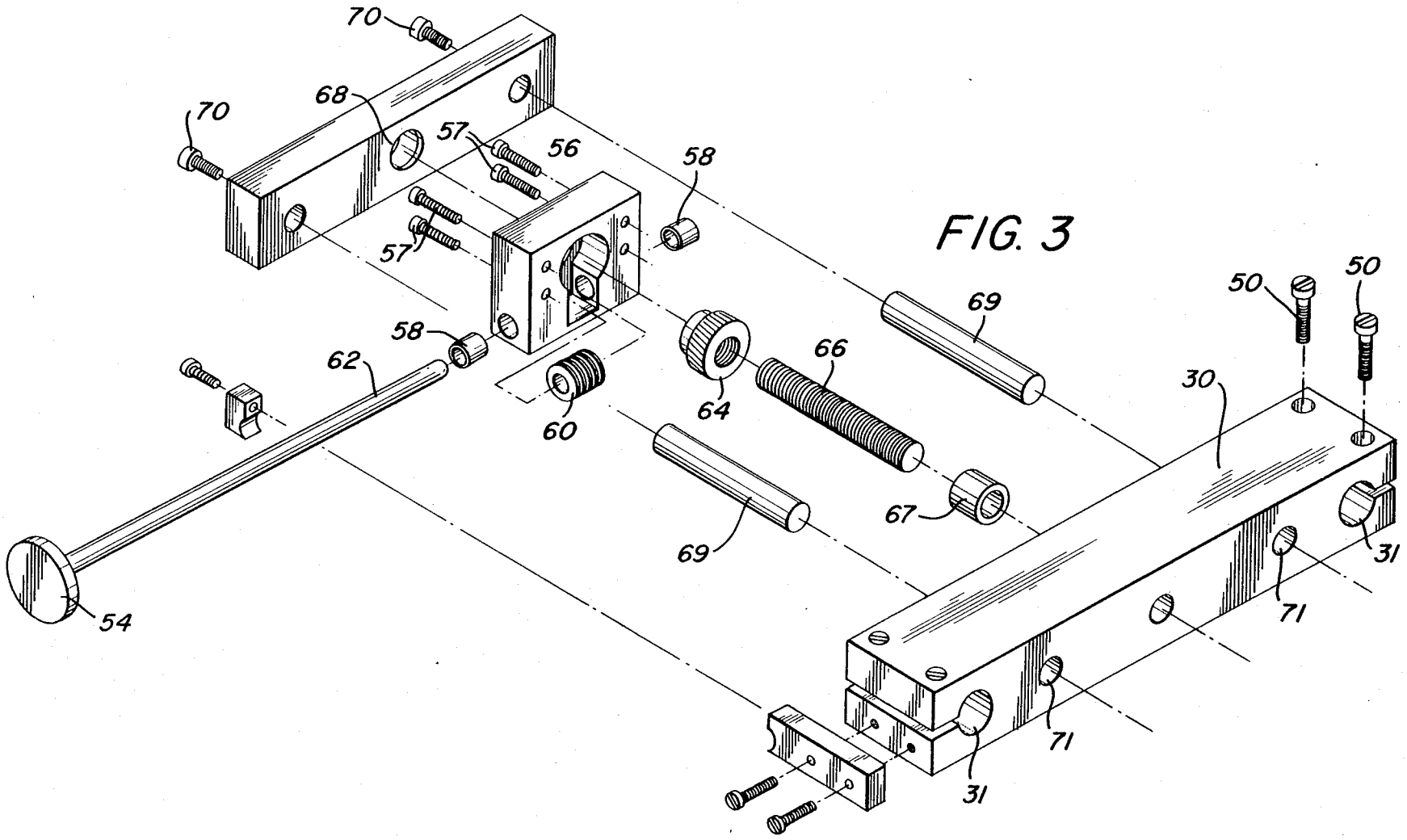
FIG. 3 depicts the fine adjustment stop bar mechanism incorporated in the apparatus of FIGS. 1–3.

FIG. 3 depicts in greater detail the fine adjustment bar 32 which was shown in FIG. 1, as well as an exploded view of the adjustment mechanism. As previously stated, the fine position stop bar establishes with greater accuracy the rearward stroke position of the feed block 18. As shown, the main adjustment bar 30 is supported on the guide rods 16 (not shown here) through a corresponding pair of bores 31. To adjust the longitudinal position of the adjustment bar 30, a series of bolts 50 (only two are shown) are loosened and the adjustment bar 30 is slid along the guide rod 16 to an approximate position of the rear limit of the desired stroke of the feed block 18. Once that approximated position is established, the location of the fine adjustment bar 32 is then established by a hand crank 54, which through a gearing arrangement, next described, repositions the longitudinal position of the fine adjustment bar 32 to a much finer position and with greater tolerance.

The preferred assembly for adjusting the position of the fine adjustment bar 32 comprises a housing 56 which supports a shaft 62 in a pair of bushings 58. The shaft 62 connects to the hand crank 54 which is supported by the housing 56. The housing 56 is held against the stop block 30 by bolts 57. A worm 60 is mounted in the housing 56 and coupled to the shaft 62. A worm gear 64 in the housing 56 is meshed with the worm 60 and has its axis disposed perpendicular to and offset from the axis of the worm 60. Rotation of the shaft 62 also effects rotation of the worm 60 against the teeth of the worm gear 64 thereby to cause a fine adjustment screw 66 threaded with the worm gear 64 to be advanced or retarded, depending upon the direction of rotation of the shaft 62.

One end of the fine adjustment screw 66 protrudes through a bushing 67 into a hollow portion of the main adjustment stop bar 30, while the opposite end of the fine adjustment screw 66 abuts an inset 68 of the fine adjustment stop bar 32. A pair of alignment rods 69 couple the fine adjustment bar 32 via connecting bolts 70 so that, as the adjustment screw 66 is moved to and fro, the bar 32 is guided longitudinally in relation to the stop bar 30 in a path defined by alignment bores 71 which are journalled through the stop bar 30. Thus, by providing such an adjustment assembly, the stock feeder may be "fine tuned" to more precisely meet the desired stroke path for the feed block 18 and also more accurately synchronize the operation of the pneumatic valves with movement of the feed block 18.

Figure 4:
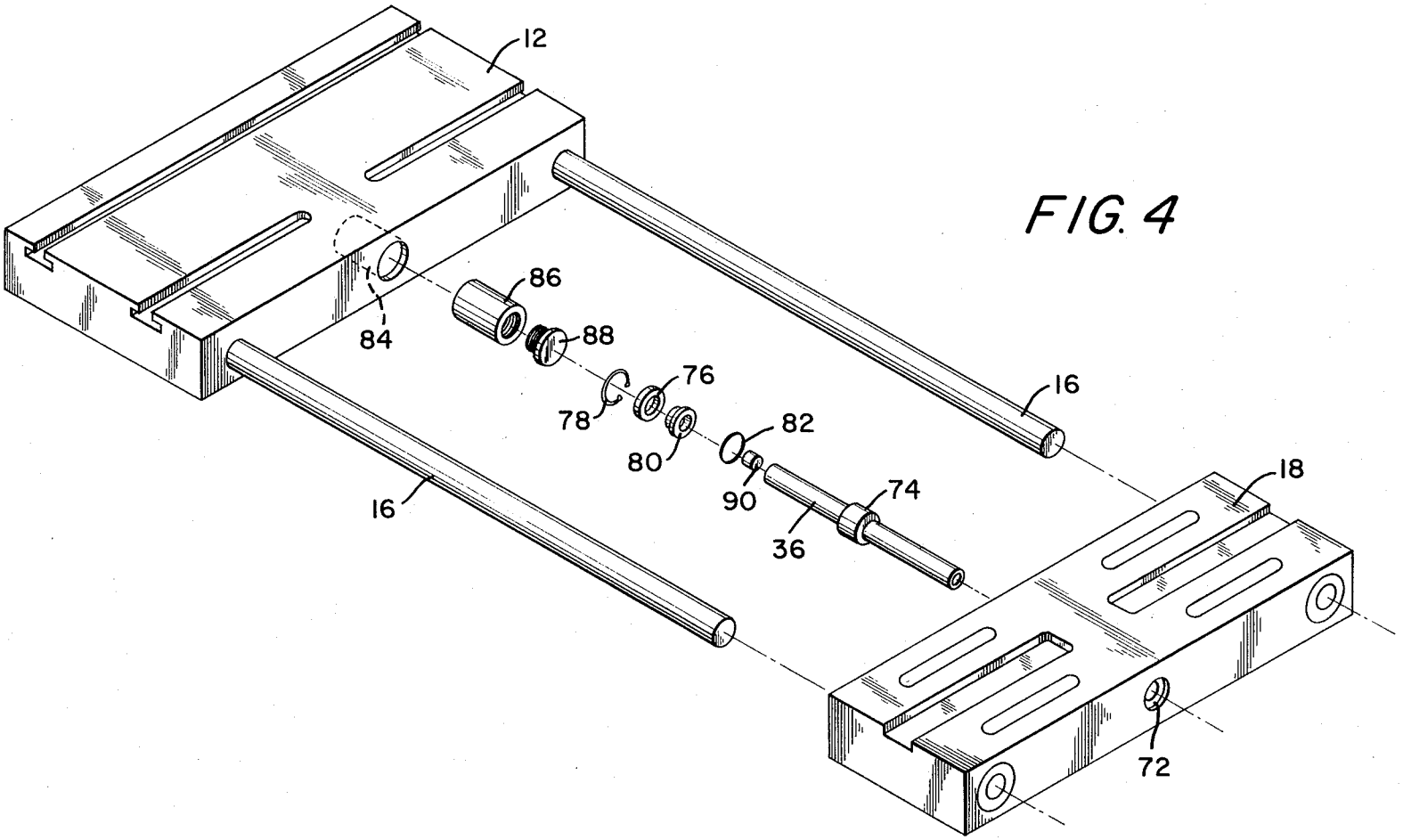
FIG. 4 depicts the hydraulic shock absorber mechanism incorporated in the apparatus of FIGS. 1–3.

FIG. 4 depicts an exploded perspective in view of the hydraulic shock absorber rod 36 and associated components which were described briefly with reference to FIG. 1. As shown, the movable feed block 18 includes a cylinder 72 journalled therethrough for receiving the hydraulic rod 36. A piston 74 coupled to the hydraulic rod 36 coacts with the cylinder 74 to form a hydraulic shock absorber. The hydraulic rod 36 is retained in the feed block 18 by a retainer plate 76 and a lock ring 78. A seal 80 and an O-ring 82 maintains fluid in the chamber constituted by the annular space between the surface of the hydraulic rod 36 and the internal surface of the cylinder 72.

On the front portion 12 of the frame, an inset 84 receives a sleeve 86 having threads disposed on the inner surface thereof. An adjustment screw 88 is held in place by the threads inside of the sleeve 86. The location in the sleeve 86 of the screw 88 determines when the slowdown operation of the movable feed block 18 begins. Accordingly, this mechanism also provides means to "fine tune" the timing of the valving operation of the pneumatic clamps at the forward and rearward stroke limits of the feed block 18, thus permitting faster operation of the stock feeder.

To reduce the impact noise which would otherwise occur when the hydraulic rod 36 engages the surface of the adjustment screw 88, there is provided a pad of polyurethane material 90 on the end of the rod 36. Other types of impact absorbing material, such as rubber, plastics, and synthetic materials could be used. Further, the pad 90 could, as well, be placed on the surface of the adjustment screw 88.

In operation, when the actuator drives the movable feed block 18 in a forward stroke, the hydraulic rod engages the adjustment screw 88 in the forward portion 12. Upon engagement, the feed block 18 begins to slow down due to a restrictive action caused by hydraulic fluid passing around piston 74. Upon reaching its forward limit in the stroke, the movable feed block engages limit switches (not shown) which then operates a valve assembly (also not shown) to cause reversal of the feed block 18 about its guide rods 16. The provision of the adjustment screw 88 enables the slow down of the feed block 18 and contacting of the limit switches a time instance which can be synchronized with the valving operation to reverse the direction of the feed block 18. More accurate timing and synchronization permits the feeding apparatus to be operated at much higher speeds than would otherwise be possible. Also, it is less likely that damage would be done to the machine during high feeding rates.

Accordingly, there is provided an improved apparatus for handling material which is more versatile than prior art devices. As described, the improved feeder is more readily adaptable to stock materials of different widths and can conveniently and quickly be adjusted to minimize down time of the feeder. Further, the hydraulic rod providing a profiled slow down of the feed block at its forward and rearward position, which positions are adjustable to some extent. This adjustment helps to synchronize the contacting of the limit switches on the forward and rearward stroke positions thereby to more effectively control the valving operation of the pneumatic circuits and thus permit the machine to operate at much higher speeds.

The foregoing illustrates only an illustrative embodiment of the invention. Modifications and changes thereof can be made without departing from the true scope and spirit of the invention. That being the case, it is not our intent to limit the invention to exactly what is shown and described, but to also include those modifications and variations which may be apparent to those skilled in the art to which this subject matter pertains.

What is claimed is:

1. A stock feeder for repetitively feeding or advancing stock material, said stock feeder comprising:

a front block including two side edges, said feed block defining opposed first keyways extending from each side edge thereof, a first guide track extending between the side edges, a pair of holding clamps means, each holding clamp means defining a projection slidably mounted in a different one of said first keyways, said pair of holding clamp means being independently slidable and releasably fixable in said first keyways and capable of abutting one another, a slot defined by each holding clamp means extending across the entire width of the bottom surface of each holding clamp means and extending partially across the length of the bottom surface of each holding clamp means, a piston reciprocatively mounted in each said holding clamp means to project into said slot defined by each holding clamp means, first stock roller guides slidingly mounted in said first guide track, means for releasably fixing each first stock roller guide in said first guide track, a rear block including two side edges, said rear block defining a second guide track extending between the side edges thereof, second stock roller guides mounted in said second guide track, means for releasably fixing said second stock roller guide in said second guide track, guide rods interconnecting said front block and said rear block, said guide rods being aligned parallel to each other, a unitary feed block including two side edges, said unitary feed block slidably mounted on said guide rods, said unitary feed block located between said front block and said rear block, said unitary feed block defining opposed second keyways extending from each side edge thereof, a pair of gripping clamps means, each gripping clamp means slidably mounted in a different one of said second keyways, said pair or gripping clamp means being independently slidable and releasably fixable in said second keyways and capable of abutting one another, a slot defined by each gripping clamp means extending across the entire width of the bottom surface of each gripping clamp means and extending partially across the length of the bottom surface of each gripping clamp means, a piston reciprocatively mounted in each said gripping clamp means to project into said slot defined by each gripping clamp, a stop block slidingly mounted on said guide rods for adjusting the distance of travel of said unitary feed block, said stop block being located between said unitary feed block and said rear block, means for releasably fixing said stop block to said guide rods, a fine adjustment bar for further adjusting the distance of travel of said unitary feed block, said fine adjustment bar being located between said unitary feed block and said stop block, means for adjusting said fine adjustment bar to change the distance between the fine adjusting bar and the stop block, means for reciprocatively moving said unitary feed block along said guide rods, and control means for controlling the advancement of successive segments of stock material by said unitary feed block.

2. A stock feeder according to claim 1, further comprising a crash stop means mounted on the front block.

3. A stock feeder as claimed in claim 2, further comprising a cylinder defined by the unitary feed block aligned parallel to the guide rods, a shock absorber rod extending through said cylinder, said shock absorber rod slidingly engaging the end faces of the cylinder, one end of the shock absorber rod being adapted to engage said crash stop pad means, and a piston mounted on the shock absorber rod being slidingly mounted in the cylinder.

4. A stock feeder as claimed in claim 1, wherein said means for adjusting said fine adjustment bar includes a housing secured to the stop block located between the fine adjustment bar and the stop block, said housing defining three openings, a first opening extending in a direction parallel to the guide rods, a second opening extending from a side of the housing to the first opening in a direction perpendicular to the guide rods, and a third opening extending from an opposite side of the housing to the first opening in a direction perpendicular to the guide rods, a shaft extending through said second and third openings, a worm mounted on said shaft and located in said first openings, an internally thread worm gear located in said first opening and engaging said worm, the ends of said internally threaded worm gear being held in position by said housing and said stop block, and a screw threaded through said internally threaded worm gear, one end of the screw abutting said fine adjustment bar and the other end of the screw protruding into said stop block.

5. A stock feeder as claimed in claim 1, wherein said means for reciprocatively moving said unitary feed block includes a first wheel, a second wheel, a piston cylinder interconnecting said front block and said rear block and aligned parallel to the guide rods, a piston slidingly mounted in said piston cylinder, and two cables, one cable connected at one end on one side of the piston and extending partially around the periphery of the first wheel and connected at its other end to the unitary feed block and the other cable connected at one end to the other side of the piston and extending partially around the periphery of the second wheel and connected at its other end to the unitary feed block.

* * * * *